US009101966B2

(12) United States Patent
Boday et al.

(10) Patent No.: US 9,101,966 B2
(45) Date of Patent: Aug. 11, 2015

(54) CLEANING MAGNETIC TAPE

(75) Inventors: Dylan J. Boday, Tucson, AZ (US); Wayne A. McKinley, Tucson, AZ (US); Richard A. West, Tucson, AZ (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 823 days.

(21) Appl. No.: 12/861,708

(22) Filed: Aug. 23, 2010

(65) Prior Publication Data

US 2012/0042899 A1 Feb. 23, 2012

(51) Int. Cl.
*B08B 3/04* (2006.01)
*B08B 1/02* (2006.01)

(52) U.S. Cl.
CPC .. *B08B 3/041* (2013.01); *B08B 1/02* (2013.01)

(58) Field of Classification Search
USPC ..... 134/9, 122 R, 122 P, 64 R, 64 P
See application file for complete search history.

(56) References Cited

U.S. PATENT DOCUMENTS

| | | | | | |
|---|---|---|---|---|---|
| 2,259,260 | A | * | 10/1941 | Matteson et al. | 134/1 |
| 3,158,886 | A | * | 12/1964 | Grimes | 15/100 |
| 3,296,710 | A | * | 1/1967 | Krikorian | 34/95 |
| 3,635,762 | A | | 1/1972 | Ott et al. | 134/1 |
| 4,244,078 | A | | 1/1981 | Hughes et al. | 15/302 |
| 4,400,846 | A | | 8/1983 | Sanderson | 15/306 A |
| 4,605,027 | A | * | 8/1986 | Dallot | 134/108 |
| 4,704,803 | A | * | 11/1987 | Valentini | 34/336 |
| 5,349,713 | A | | 9/1994 | Stimpfl | 15/1.51 |
| 5,938,858 | A | | 8/1999 | Yokoyama et al. | 134/9 |
| 6,478,879 | B1 | | 11/2002 | Jackson | 134/7 |
| 6,503,332 | B1 | | 1/2003 | Kawanishi et al. | 134/1 |
| 6,797,072 | B1 | | 9/2004 | Richardson | 134/15 |
| 2008/0236627 | A1 | | 10/2008 | Kominami et al. | 134/18 |

FOREIGN PATENT DOCUMENTS

| | | | |
|---|---|---|---|
| GB | 1287876 | 9/1972 | B08B 11/00 |
| GB | 1314384 | 4/1973 | G03D 3/00 |
| JP | 2002245748 | 8/2002 | |

* cited by examiner

*Primary Examiner* — David Cormier
(74) *Attorney, Agent, or Firm* — John H. Holcombe

(57) ABSTRACT

Methods and apparatus provide for non-destructive cleaning of magnetic tape. In one embodiment, a continuing length of the magnetic tape is submersed and passed through a covered solvent bath; and each side (front and back) of the continuing length of magnetic tape is swabbed with a cotton swab subsequent to the submerging step. The cotton swabs are arranged to swab each respective side of the magnetic tape.

6 Claims, 3 Drawing Sheets

CLEANING MAGNETIC TAPE

CROSS REFERENCE TO RELATED APPLICATION

Commonly assigned copending U.S. patent application Ser. No. 12/861,673, filed on even date herewith, relates to extraction of surface contamination of magnetic tape.

FIELD OF THE INVENTION

This invention relates to magnetic tape, and more particularly, to cleaning the surface of the magnetic tape.

BACKGROUND OF THE INVENTION

Magnetic tape comprises an important media for the storage of data, including the long term storage and archiving of data. The presence of contamination and debris on the surface of magnetic tape is becoming increasingly important due to the potential corrosion caused by chemical contamination to the magnetic tape, or to disruption of the head/tape interface caused by debris.

A magnetic tape is long, for example, 600 meters, and the contamination and debris may be scattered over the entire length of the magnetic tape. Contamination materials may be bound to the surface of the tape and attempting to remove them by abrasion may damage the tape.

SUMMARY OF THE INVENTION

Methods and apparatus are provided for non-destructive cleaning of magnetic tape.

In one embodiment, the method comprises submersing and passing a continuing length of the magnetic tape through a covered solvent bath; and swabbing each side (front and back) of the continuing length of magnetic tape.

In a further embodiment, the swabbing step comprises swabbing each side of the continuing length of magnetic tape with a cotton swab subsequent to the submerging step, wherein each cotton swab comprises a generally cylindrical surface arranged to contact respectively one of the front and back side of the magnetic tape and is arranged to be out of the solvent bath.

In a still further embodiment, each of the cotton swabs comprises a replaceable cotton sleeve.

In another embodiment, the solvent bath comprises either a hydrophobic or a hydrophilic solvent.

In still another embodiment, the submersing and passing step comprises a speed of longitudinal passing of the magnetic tape of between 0.01 meters per second and 0.3 meters per second.

In a further embodiment, the speed comprises substantially 0.2 meters per second.

In another embodiment, the method additionally comprises a wiping step subsequent to the submersing and swabbing steps. The wiping step comprises passing the continuing length of magnetic tape between opposed brushes, the brushes contacting respectively the front and the back sides of the magnetic tape to wipe the both sides of the magnetic tape simultaneously in a squeegee action.

In a further embodiment, the brushes comprise polymer brushes.

In another embodiment, the solvent bath is heated to a temperature of between room temperature and 70 degrees Celsius.

In still another embodiment, the method additionally comprises, subsequent to the swabbing step, air drying the continuing length of magnetic tape externally of the covered solvent bath.

For a fuller understanding of the present invention, reference should be made to the following detailed description taken in conjunction with the accompanying drawings.

DETAILED DESCRIPTION OF THE INVENTION

This invention is described in preferred embodiments in the following description with reference to the Figures, in which like numbers represent the same or similar elements. While this invention is described in terms of the best mode for achieving this invention's objectives, it will be appreciated by those skilled in the art that variations may be accomplished in view of these teachings without deviating from the spirit or scope of the invention.

Figure 1:
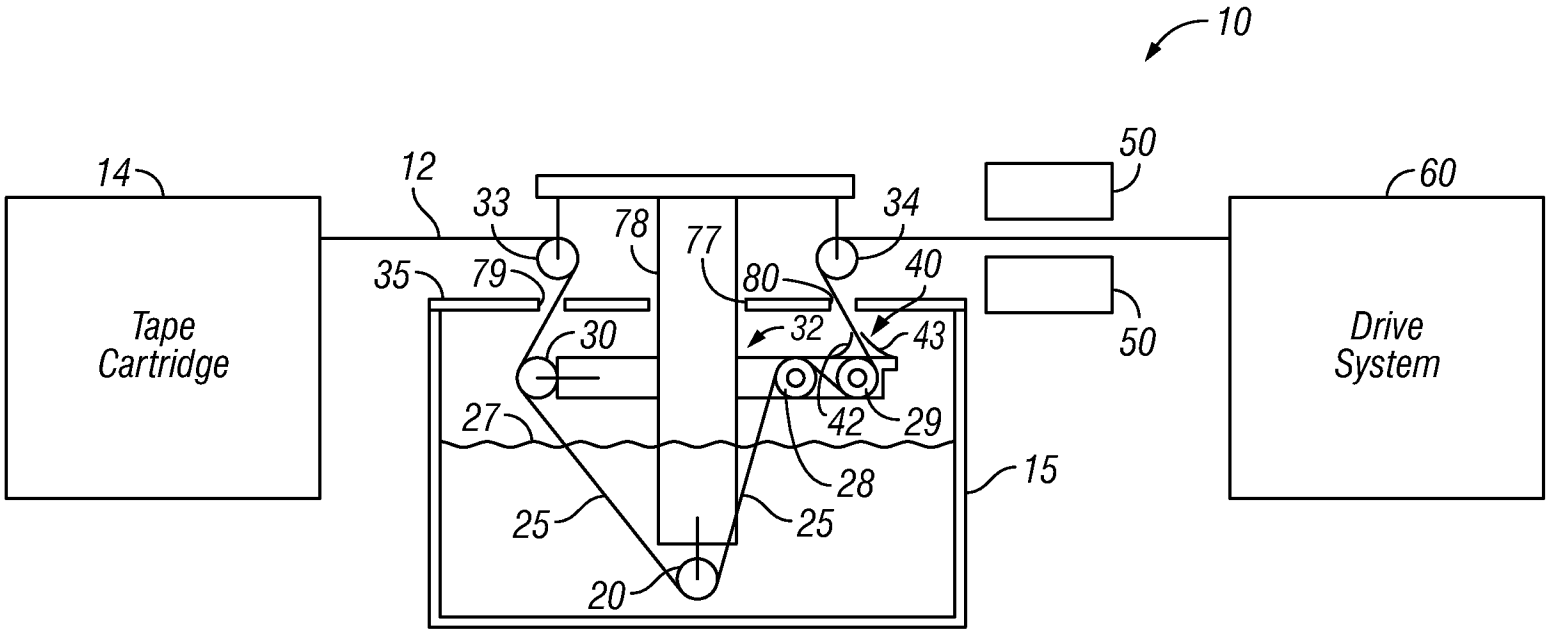
FIG. 1 is a diagrammatic illustration of a system configured to clean magnetic tape.
Figure 2A:
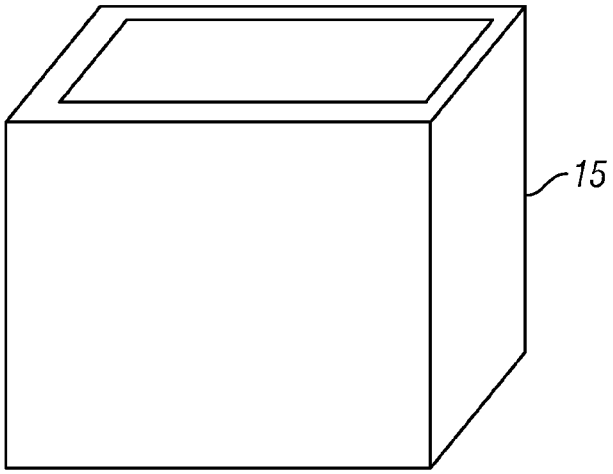
FIGS. 2A and 2B are illustrations of respectively, a container and cover of the system of FIG. 1.
Figure 2B:
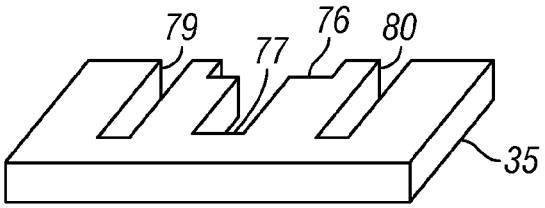

Referring to FIGS. 1, 2A and 2B, an example of a system 10 is illustrated which is configured to clean the surface of a magnetic tape 12 of a tape cartridge 14. Contamination materials and debris may be present on the surface of magnetic tape. The contamination is becoming increasingly important due to the potential corrosion caused by chemical contamination to the magnetic tape. Debris on the tape may cause disruption of the head/tape interface. Contamination materials and debris may transfer to components of the magnetic tape drives employed to write and read data with respect to the magnetic tape. Examples of contamination materials and debris comprise lubricants, adhesives and other common organic and inorganic contaminants and debris that commonly come from environmental sources and deposit onto the tape surface. The contamination materials may also cause corrosion to surfaces and components of magnetic tape drives.

The system 10 is configured to clean surface contaminants and debris from substantially an entire spool of magnetic tape 12 of tape cartridge 14. The system 10 comprises a container 15 and a guide system 18 of at least one guide 20 configured to pass a continuing length 25 of magnetic tape 12. The guide system 18 is configured to guide and pass the continuing length of tape 25 within a solvent bath 27, submersing the magnetic tape in the solvent bath.

Examples of solvents comprise but are not limited to water, hexanes, ethanol, methanol and iso-propanol. The solvents listed are either polar or non-polar, meaning that they are hydrophilic (water loving) or hydrophobic (water hating). Submersion of the continuing length of magnetic tape 25 in the solvent bath 27 dissolves certain contamination materials, thereby extracting the materials from the magnetic tape into the solvent bath. Those of skill in the art will understand the relationships between specific solvents and the materials that are dissolved when the magnetic tape is submerged therein. Those of skill in the art also understand that other solvents than those listed may be employed to dissolve various contamination materials. In order to dissolve all of the various kinds of contamination materials, the solvent may have to be changed from one to another, and the magnetic tape may have to be submerged and passed through one solvent and submerged again and passed through a different solvent. This process may be repeated.

The magnetic tape may be supported and directed by additional guides such as guide 30, supported by support 32, which is configured to guide the magnetic tape 25 within the container 15, and by guides 33 and 34 outside the container 15. The guides may comprise bearings with or without flanges, or may comprise cylindrical surfaces with or without flanges, to guide the magnetic tape along the tape path, as will be discussed.

A cover 35 is placed so as to cover the solvent bath 27 and the guides 30 and 20 that are within the container 15. The cover 35 minimizes the solvent loss from solvent bath 27 due, for example, to splashing and evaporation.

As the result, the covered enclosure 15, 35 encloses at least one guide 20, and encloses the solvent bath 27 to a level at least submersing the guide and submersing the continuing length of magnetic tape 25 passed by the guide.

A swabbing arrangement comprising cotton swabs 28 and 29 is configured to swab each side (front and back) of the continuing length of magnetic tape. Each cotton swab 28, 29 comprises a generally cylindrical surface arranged to contact respectively one of the front and back side of the magnetic tape and is arranged to be out of the solvent bath. In the example, each of the cotton swabs 28, 29 comprises a cotton sleeve. The magnetic tape passes the cotton swabs 28, 29 subsequent to submersion in the solvent bath 27, while the magnetic tape is within the covered enclosure 15, 35. The swabbing arrangement 28, 29 contacts the magnetic tape while the tape is held under low tension, and the tension provides an abrasive force that removes debris that was not affected by the solvent sufficiently to be extracted from the magnetic tape. The cotton swabs may also tend to absorb contamination materials. The cotton swabs may be in the form of sleeves mounted on spindles and may be removed and replaced.

A wiping arrangement 40, or wiper, for example comprising opposed brushes 42 and 43, is configured to contact respectively the front and back of the magnetic tape as the continuing length of magnetic tape exits the swabbing arrangement. The magnetic tape passes between the opposed brushes 42, 43 subsequent to abrasion by the swabbing arrangement 28, 29, while the magnetic tape is within the covered enclosure 15, 35. The wiping arrangement 40, or wiper, thereby wipes both sides of the magnetic tape, to reduce the likelihood that solvent is carried from the bath 27 on the tape. In one example, the brushes of wiper 40 wipe both sides of the magnetic tape simultaneously in a squeegee action.

The magnetic tape is directed through the cover 35 and guide 34 directs the magnetic tape 12 through a drier 50. The drier 50 is external to the solvent bath enclosure and may, for example, be an air drier configured to dry both sides of the magnetic tape 12. The air drier primarily employs the movement of air to dry the magnetic tape and the temperature of the air drier will not exceed 70 degrees Celsius. Air driers are known to those of skill in the art. Drier 50 is intended to further dry the magnetic tape and to eliminate the possibility that the tape surfaces would have deposited solvents or become stuck once the magnetic tape is rewound in the tape cartridge 14.

A drive system 60 pulls the magnetic tape in a longitudinal path extending from the tape cartridge 14, through the solvent bath 27, submerging the continuing length of magnetic tape 25 in the solvent bath, through the swabbing arrangement 28, 29, through wiping arrangement 40, and through external drier 50. The drive system 60 is arranged to move the tape longitudinally from the tape cartridge 14 with a tension sufficient to maintain the magnetic tape 12 against the swabs 28, 29, and guides 30, 33, 20 and 34 without the development of slack. The entire spool of magnetic tape from tape cartridge 14 is thus submerged in solvent bath 27 to dissolve and extract the contamination materials into the solvent bath, and to have debris removed by the swabbing arrangement 28, 29.

Referring to FIGS. 1 and 2B, the support 32 and guide system 18 are supported by a back bracket which may be attached to the rear of the container 15, for example above the solvent bath. The notch 76 of cover 35 is arranged to clear the back bracket, while notch 77 is arranged to clear the vertical portion 78 of the support 32. Further notches 79 and 80 are arranged to clear the magnetic tape as it enters and exits the container 15, respectively.

Once substantially the entire length of magnetic tape has passed through the solvent bath 27 and the swabbing arrangement 28, 29, the magnetic tape is withdrawn from enclosure 15 and is rewound into the tape cartridge 14, for example, by the drive system 60.

Figure 3:
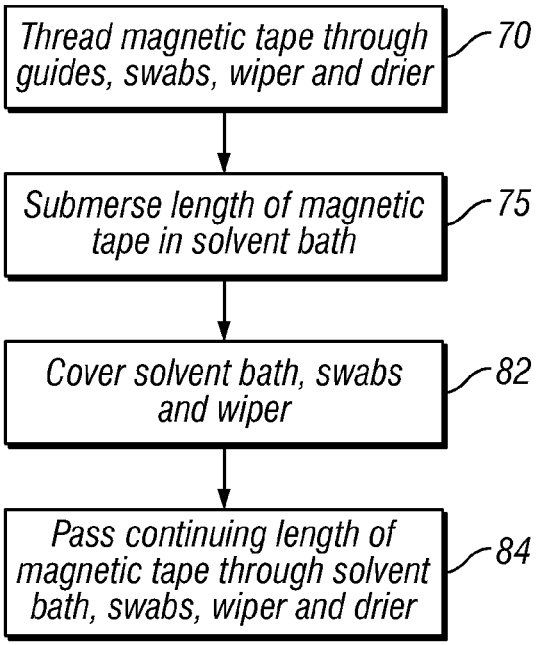
FIG. 3 is a flow chart depicting an exemplary method of operating the system of FIGS. 1 and 2.

Referring additionally to FIG. 3, the method for extracting the contamination materials comprises, in step 70, threading the magnetic tape 12 into the guide system 18, and through the wiping arrangement 40 and drier 50. In the illustrated example, the magnetic tape is also threaded along guides 33, 30 and along guide 20 of guide system, and threaded through the swabbing arrangement of swabs 28 and 29, and through the brushes 42, 43 of wiping arrangement, or wiper, 40, and along guide 34 and through the drier 50 to drive system 60.

The selected solvent is placed in the container 15 to form the solvent bath 27 in step 75, in one example, the unit comprising guide system 18 and support 32 and guide 30 is placed within the container 15 while the cover 35 is off and placed at the proper depth in the solvent bath 27 so as to submerse guide 20 and length of magnetic tape 25 in the solvent bath. Swabs 28 and 29 and brushes 42 and 43 are not submersed.

The solvent bath 27 may be heated to a temperature of between room temperature and 70 degrees Celsius, either preheated before being placed in container 15, or container 15 may comprise a heating element to heat the solvent bath.

Referring to FIGS. 1, 2A, 2B and 3, in step 82, cover 35 is placed at the container 15 so as to cover at least the solvent bath 27. In the example, the cover is placed on the top of the container 15, covering the solvent bath 27, length of magnetic tape 25, swabbing arrangement 28, 29 and wiper 40.

In step 84, the continuing length of magnetic tape 25 is drawn by drive system 60 along the guides to pass the continuing length of magnetic tape through the solvent bath 27, submerging the continuing length of magnetic tape in the solvent bath, then from the solvent bath through the swabs 28 and 29, through wiper 40, and from the container 15 through the external drier 50.

The drive system 60 passes the magnetic tape in the longitudinal direction of the tape at a speed of between 0.01 meters per second and 0.3 meters per second. In a specific embodiment, the speed comprises substantially 0.2 meters per second. The drive system 60 additionally is arranged to control the tape cartridge 14 to provide a tension on the magnetic tape that is sufficient to hold the continuing length of magnetic tape against the swabs 28 and 29 as it exits the solvent bath.

Thus, the continuing length of magnetic tape is submersed and passed through a covered solvent bath; and, subsequent to the submersing step, the magnetic tape is swabbed on each side (front and back), cleaning the magnetic tape in a non-destructive manner.

The entire spool of magnetic tape 12 from tape cartridge 14 is thus drawn through the solvent bath 27, the solvent bath dissolving contamination materials that are present on the surface of the magnetic tape in accordance with the selected solvent. A magnetic tape 12 is long, for example, 600 meters, so that passing a continuing length of the magnetic tape 25, which comprises less than 1/1000 of total length of the magnetic tape 12, through the solvent bath 27 results in removing contaminating materials from substantially the entire length of the magnetic tape. These contamination materials commonly come from environmental sources and deposit onto the tape surface and can then cause corrosion to the tape, and to surfaces and components of a tape drive that the tape is used in.

The swabbing step comprises swabbing each said side of the continuing length of said magnetic tape with the cotton swabs 28 and 29 under tension so that the swabs tend to remove debris from the magnetic tape. Each swab comprises a generally cylindrical surface arranged to contact respectively one of the front and back side of said magnetic tape and is arranged to be out of said solvent bath. In the example, the cotton swabs are in the form of sleeves and are removable such that the swabs may be replaced. Thus, debris is removed from substantially the entire length of the magnetic tape. The debris, without removal, may lead to disruption of the head/tape interface.

Figure 4B:
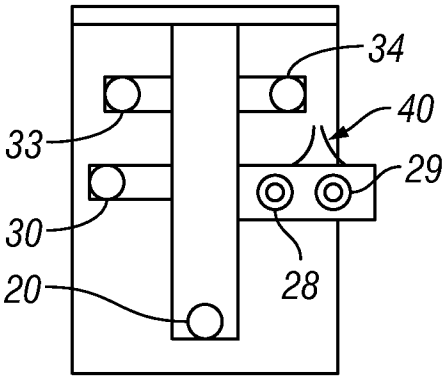
FIGS. 4A and 4B are illustrations of the guide, support system, and swabs of the system of FIGS. 1 and 2.
Figure 4A:
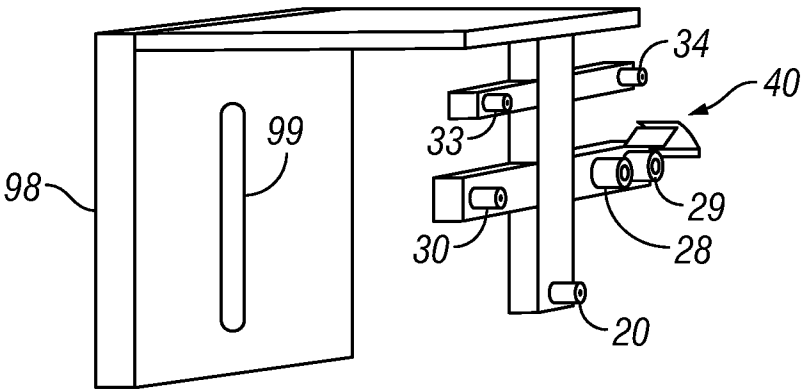

FIGS. 4A and 4B illustrate one embodiment of the guide system, support, guides and bracket that may be employed in the system 10 of FIG. 1. Guides 33, 30, 20 and 34, in one embodiment, comprise roller bearing guides which may comprise flanges to guide the magnetic tape. Examples of such roller bearing guides are known to those of skill in the art. An alternative embodiment of the guides 33, 30, 20 and 34 comprises cylindrical surfaces, such as pins which may comprise flanges to guide the magnetic tape. Examples of such cylindrical surfaces, partial or full, are known to those of skill in the art. The swabbing arrangement 28, 29 and wiper 40 are also illustrated. The swabs, wiper and guides are supported by a rear bracket 98 that may be attached through slot 99 to the rear of the container 15 of FIG. 1.

Referring to FIG. 1, drive system 60 may comprise any suitable means for winding the magnetic tape 12 on a take up reel to pass the magnetic tape through the solvent bath 27 and through the swabbing arrangement 28, 29, through wiper 40 and drier 50 with a small amount of tension on the magnetic tape 12 to maintain the magnetic tape in the tape path and to provide an abrasive force for the swabs. One example comprises a drive motor and take up reel of a magnetic tape drive.

Those of skill in the art will understand that changes may be made with respect to the methods discussed above, including changes to the ordering of the steps. Further, those of skill in the art will understand that differing specific component arrangements may be employed than those illustrated herein.

While the preferred embodiments of the present invention have been illustrated in detail, it should be apparent that modifications and adaptations to those embodiments may occur to one skilled in the art without departing from the scope of the present invention as set forth in the following claims.

What is claimed is:

1. Apparatus for cleaning magnetic tape, comprising:

at least one guide configured to pass a continuing length of magnetic tape thereby;

a covered enclosure configured said at least one guide, and enclose a solvent bath to a level at least submersing said at least one guide and submersing a continuing length of said magnetic tape passed by said at least one guide;

a swabbing arrangement mounted to be out of said solvent bath and within said covered enclosure, and configured to swab front and back sides of said continuing length of said magnetic tape subsequent to submersion in said solvent bath while said magnetic tape is within said covered enclosure and provide an abrasive force for removing debris from said magnetic tape; wherein said swabbing arrangement comprises a plurality of cotton swabs mounted one after the other in a path of said continuing length of magnetic tape, wherein each said cotton swab comprises a generally cylindrical surface arranged to contact respectively one of said front and back side of said magnetic tape; and a drier external of said, covered enclosure configured to be in a path of said continuing length of magnetic tape subsequent to said swabbing arrangement, configured to air dry said continuing length of magnetic tape.

2. The apparatus of claim 1, wherein each of said cotton swabs comprises a replaceable cotton sleeve.

3. The apparatus of claim 1, additionally comprising apparatus for moving said magnetic tape in a longitudinal direction such that continuing length of magnetic tape passes said at least one guide at a speed of between 0.01 meters per second and 0.3 meters per second.

4. The apparatus of claim 3, wherein said speed comprises substantially 0.2 meters per second.

5. Apparatus for cleaning magnetic tape, comprising:

at least one guide configured to pass a continuing length of magnetic tape thereby;

a covered enclosure configured to enclose said at least one guide, and enclose a solvent bath to a level at least submersing said at least one guide and submersing a continuing length of said magnetic tape passed by said at least one guide;

a swabbing arrangement mounted to be out of said solvent bath and within said covered enclosure, and configured to swab front and back sides of said continuing length of said magnetic tape subsequent said solvent bath while said magnetic tape is within said covered enclosure and provide an abrasive force for removing debris from said magnetic tape;

a drier external of said covered enclosure configured to be in a path of said continuing length of magnetic tape subsequent to said swabbing arrangement, configured to air dry said continuing length of magnetic tape; and a wiping arrangement mounted to be out of said solvent bath and within said covered enclosure, and in a path of said continuing length of magnetic tape subsequent to said swabbing arrangement, said wiping arrangement of opposed brushes contacting respectively said front and said back sides of said magnetic tape to wipe said both sides of said magnetic tape simultaneously in a squeegee action.

6. The apparatus of claim 5, wherein said brushes comprise polymer brushes.

* * * * *